US007793455B1

(12) United States Patent
Laney

(10) Patent No.: US 7,793,455 B1
(45) Date of Patent: Sep. 14, 2010

(54) LUBRICATING APPARATUS FOR A THREADED RIFLE BREECH

(75) Inventor: Mark C. Laney, Lee, NH (US)

(73) Assignee: Thompson Center Arms Company, Inc., Rochester, NH (US)

( * ) Notice: Subject to any disclaimer, the term of this patent is extended or adjusted under 35 U.S.C. 154(b) by 401 days.

(21) Appl. No.: 11/505,212

(22) Filed: Aug. 15, 2006

(51) Int. Cl.
*F41A 29/04* (2006.01)

(52) U.S. Cl. ..... 42/95

(58) Field of Classification Search ..... 42/95; 15/104.165

See application file for complete search history.

(56) References Cited

U.S. PATENT DOCUMENTS

| | | | | |
|---|---|---|---|---|
| 1,552,994 | A * | 9/1925 | Lindeman | 222/341 |
| 2,860,359 | A * | 11/1958 | James | 401/183 |
| 3,071,840 | A * | 1/1963 | Douglas | 42/78 |
| 4,854,065 | A | 8/1989 | French et al. | |
| 5,056,946 | A * | 10/1991 | Larkin | 401/11 |
| 5,615,507 | A | 4/1997 | French | |
| 5,639,981 | A | 6/1997 | French | |
| 5,680,722 | A | 10/1997 | French et al. | |
| 5,782,030 | A | 7/1998 | French | |
| 5,907,920 | A | 6/1999 | Laney | |
| 6,145,235 | A | 11/2000 | Emerson et al. | |
| 6,219,951 | B1 | 4/2001 | Cate | |
| 6,532,692 | B2 | 3/2003 | Cate | |
| 6,604,311 | B1 | 8/2003 | Laney et al. | |
| 6,834,455 | B2 | 12/2004 | Burigana | |
| 7,140,138 | B1 | 11/2006 | Laney et al. | |
| 7,257,917 | B1 | 8/2007 | Garland | |
| 2006/0248771 | A1 | 11/2006 | Richards | |
| 2007/0137084 | A1 | 6/2007 | Laney et al. | |
| 2007/0163162 | A1 | 7/2007 | Laney et al. | |

* cited by examiner

*Primary Examiner*—Stephen M Johnson
(74) *Attorney, Agent, or Firm*—McCormick, Paulding & Huber LLP

(57) ABSTRACT

A nozzle for lubricating an internally threaded rifle breech. The nozzle has a body containing a bore, with an inlet end adapted to receive a supply of lubricant. The body has an opposed end portion having a cylindrical wall and an enclosed free end. The cylindrical wall has a number of lubricant exit apertures. The body may be L-shaped, and the inlet may be threaded for connection to a lubricant container. The cylindrical wall of the end portion may have an external diameter less than an adjacent portion diameter, so that a shoulder is formed to limit insertion depth. A cap may be provided to cover the exit apertures so that the body may remain attached to the lubricant container.

10 Claims, 5 Drawing Sheets

LUBRICATING APPARATUS FOR A THREADED RIFLE BREECH

FIELD OF THE INVENTION

This invention relates to firearm accessories, and more particularly to cleaning and lubricating of firearms.

BACKGROUND AND SUMMARY OF THE INVENTION

Muzzle loading rifles have an essentially closed breech at the rear of the barrel, so that powder and bullets must be loaded at the muzzle or forward end of the barrel. A typical muzzle loading rifle has a barrel with a breech plug attached to occupy an enlarged threaded rear bore portion of the barrel at the breech end. In some rifles, the breech plug is permanently attached. In others, the breech plug is removable to facilitate pass-through cleaning of the bore.

A typical removable breech plug has a finely threaded body that screws into the rear of the barrel, with 10-15 turns to secure it in place. This facilitates removal for cleaning. However, the number of turns requires significant time and effort to remove and replace the plug, particularly when affected by the fouling associated with muzzle loading rifles. Such fouling can clog the threads, requiring an undesirably great torque to remove the plug, through the many rotations required.

Accordingly, it is common practice to apply a lubricant such as grease to the threads each time the breech is assembled. This facilitates later removal, and further occupies any gaps between the breech plug and the threaded bore to minimize incursion of fouling gases and particles. While effective, application of grease can be a messy procedure. The typical approach is for the shooter to apply a dab of grease to a fingertip, and wipe it inside the threaded bore. This is messy, does not ensure complete coverage, and the sharp threads can cause discomfort or injury. In addition, fingertip lubrication can lead to excessive lubrication. It is relatively easy for a blob of grease to be pushed beyond the threaded area, and even into the bore of the barrel. The presence of excessive grease then may lead to additional fouling, as the residue from grease combustion accumulates during firing. This also could lead to misfires because it may block the fire channel.

Other types of muzzleloading rifles employ an interrupted thread on the breech plug. These are even more difficult to manually lubricate, because the bore has threaded portions and clearance portions, and the user must avoid building up excess grease on the clearance portions, while also avoiding the sharp corners at the beginnings and ends of the threads.

In addition, the application of grease is normally made in the field, or at the firing range. Consequently, the tube of grease commonly employed is vulnerable to loss of its cap, contamination, and accumulated mess transferred from a greasy finger.

The present invention overcomes the limitations of the prior art by providing a nozzle for lubricating an internally threaded rifle breech. The nozzle has a body having a bore, with an inlet end adapted to receive a supply of lubricant. The body has an opposed end portion having a cylindrical wall and an enclosed free end. The cylindrical wall has a number of lubricant exit apertures. The body may be L-shaped, and the inlet may be threaded for connection to a lubricant container. The cylindrical wall of the end portion may have an external diameter less than an adjacent portion diameter, so that a shoulder is formed to limit insertion depth. A cap may be provided to cover the exit apertures so that the body may remain attached to the lubricant container.

DETAILED DESCRIPTION OF A PREFERRED EMBODIMENT

Figure 1:
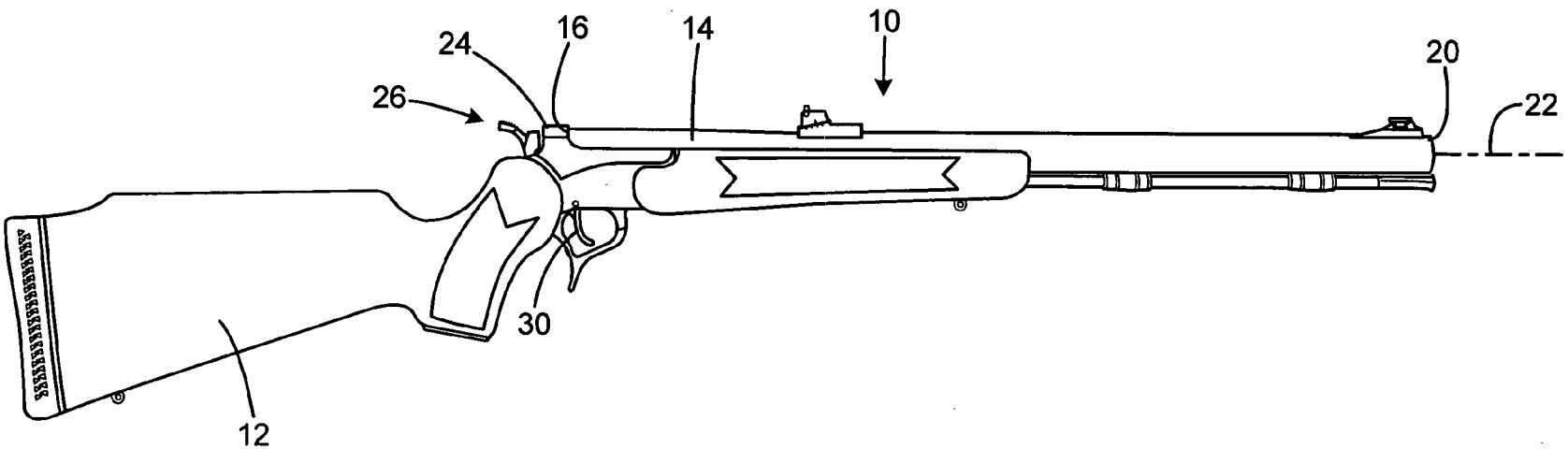
FIG. 1 is a side view of a firearm for which a preferred embodiment of the invention is adapted for use.

FIG. 1 shows a muzzle-loading firearm 10, with a stock 12 and a barrel 14 having a breech end 16 and a muzzle end 20, and having a bore defining a bore axis 22. A movable breech element 24 pivots between an open position and a closed (shown) position. A hammer 26 is pivotally connected adjacent the breech block to operate in response to operation of a trigger 30 as will be discussed below. A muzzle loading firearm having some similar features is disclosed in U.S. Pat. No. 6,604,311 to Laney et al., the disclosure of which is incorporated herein by reference.

Figure 2:
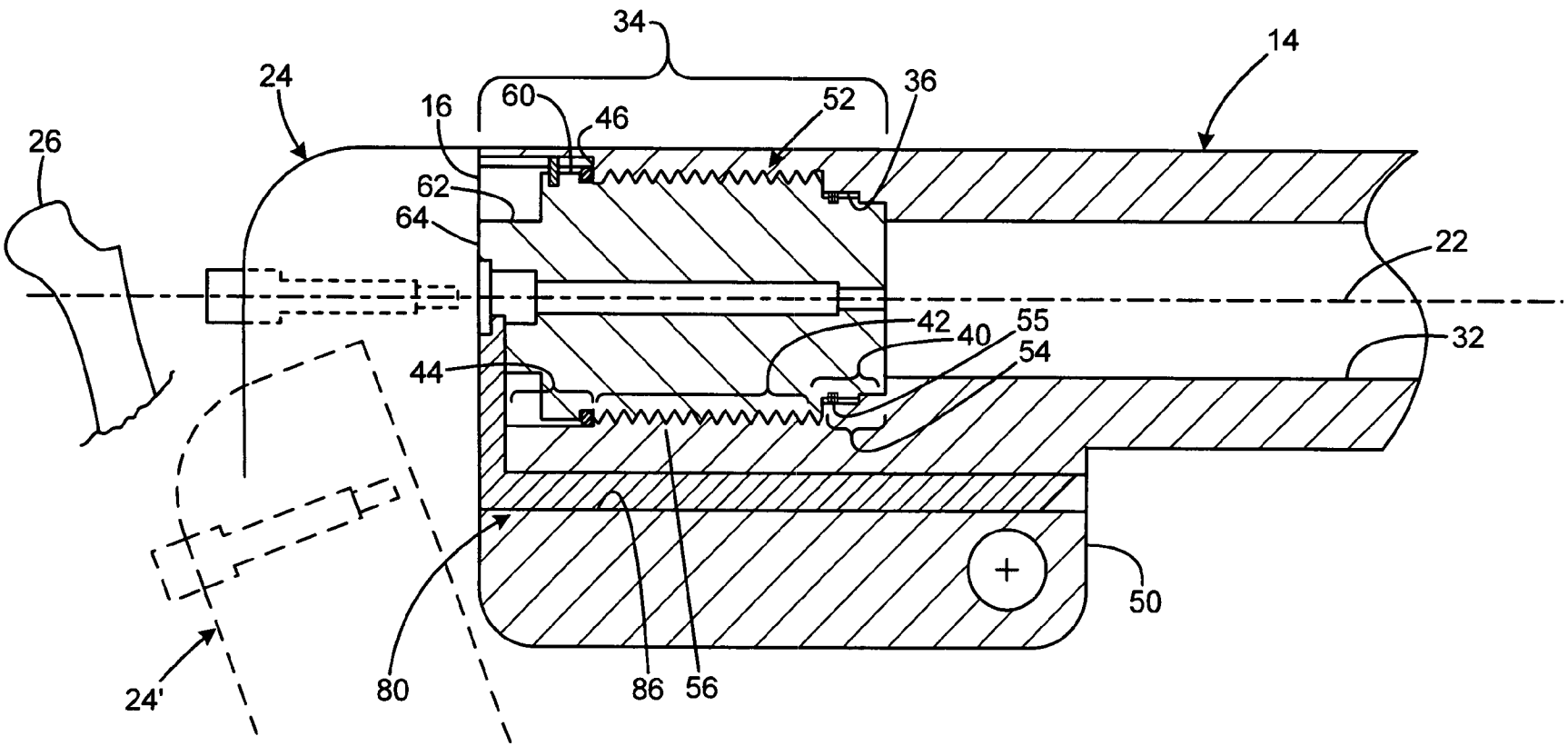
FIG. 2 is a sectional side view of the firearm of FIG. 1, taken along a medial plane.

FIG. 2 shows the breech end 16 of the barrel 14. The barrel has a rifled bore 32 (rifling not shown) that extends from the muzzle nearly the length of the barrel, except for a rear portion 34. The rear portion of the barrel contains an enlarged breech plug chamber 36 having a stepped initial portion 40, an internally threaded intermediate portion 42, and an enlarged clearance portion 44. A shoulder 46 is formed at the rear end of the threaded portion where it meets the larger-diameter clearance portion 44. A lower lug 50 is integrally connected to a rear portion of the barrel.

The rear portion of the barrel has a breech plug chamber for accepting a breech plug 52. The breech plug 52 is a generally cylindrical body with a nose portion 54 that is stepped to closely fit in the initial portion 40 of the breech plug chamber 36. Most of the length of the breech plug is provided with helical threads 56, or an alternative fastening element that provides extreme resistance to axial extraction forces, such as provided by firing a shot. The breech plug has a flange 60 that is larger in diameter than the threaded portion, and which rests against the shoulder 46 when installed, as shown. (In alternative embodiments, the axial seal may be at the nose of the breech plug.) The rear or breech end portion of the breech plug has a hexagonal profile portion 62, in the shape of a bolt head that may be engaged by a socket wrench for removing and replacing the breech plug. A flat rear face 64 of the plug's hex portion is flush with the plane defined by the breech end of the barrel.

A removable extractor 80 is a solid body with an L-shaped form, which is closely received in a bore 86 in the lower lug that extends axially, and parallel to the bore axis 22. The extractor is removable to allow removal of the breech plug.

Figure 3A:
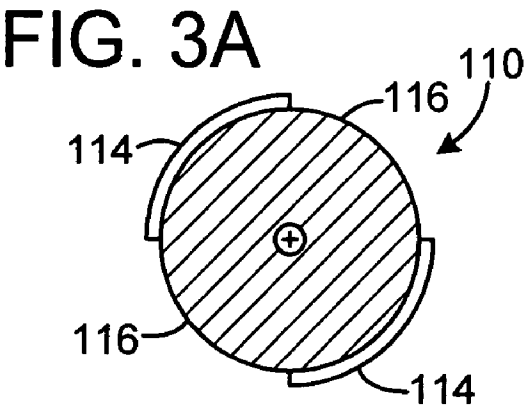
FIGS. 3 and 3A are side and sectional views of an alternative embodiment breech plug.
Figure 3:
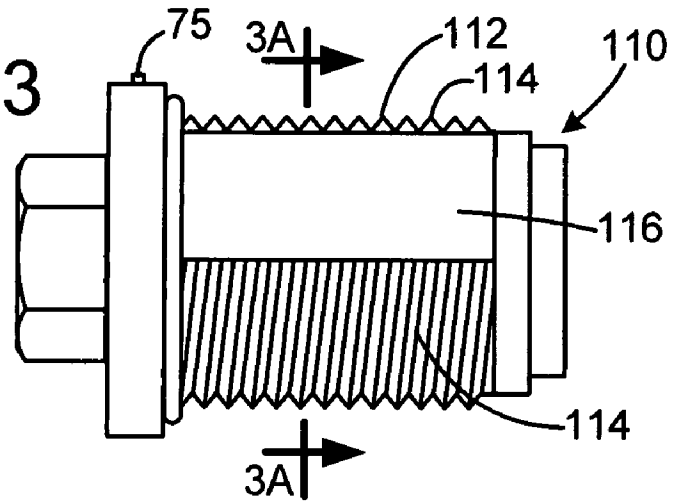

FIGS. 3 and 3A show an alternative breech plug 110 having an interrupted thread pattern 112. This pattern has conventional threads in axial stripes or zones 114 that alternate with threadless areas 116. The threadless areas 116 have a cylindrical surface at a diameter with respect to the plug axis smaller than the root diameter of the threads. The breech plug bore is machined with similar alternating patterns of threaded and threadless areas, with the threaded areas mating with the threaded areas of the breech plug, and the unthreaded areas having a radius greater than the maximum radius of the threaded areas of the plug, so that the breech plug may be axially inserted with its threads passing freely through the threadless areas of the bore, and then rotated a fractional turn to engage the threads. In the illustrated embodiment, there are four zones of about 90 degrees each, the threaded zones being less in diameter than the threadless zones, to provide insertion clearance. The breach plug requires a 90 degree turn to shift from a locked position to a removable position. Alternatively, the number of threaded zones may be established at any integer "n", so that a turn angle of 360/n degrees is provided. In the illustrated embodiment, the threads have a pitch of 16 threads per inch.

Figure 4:
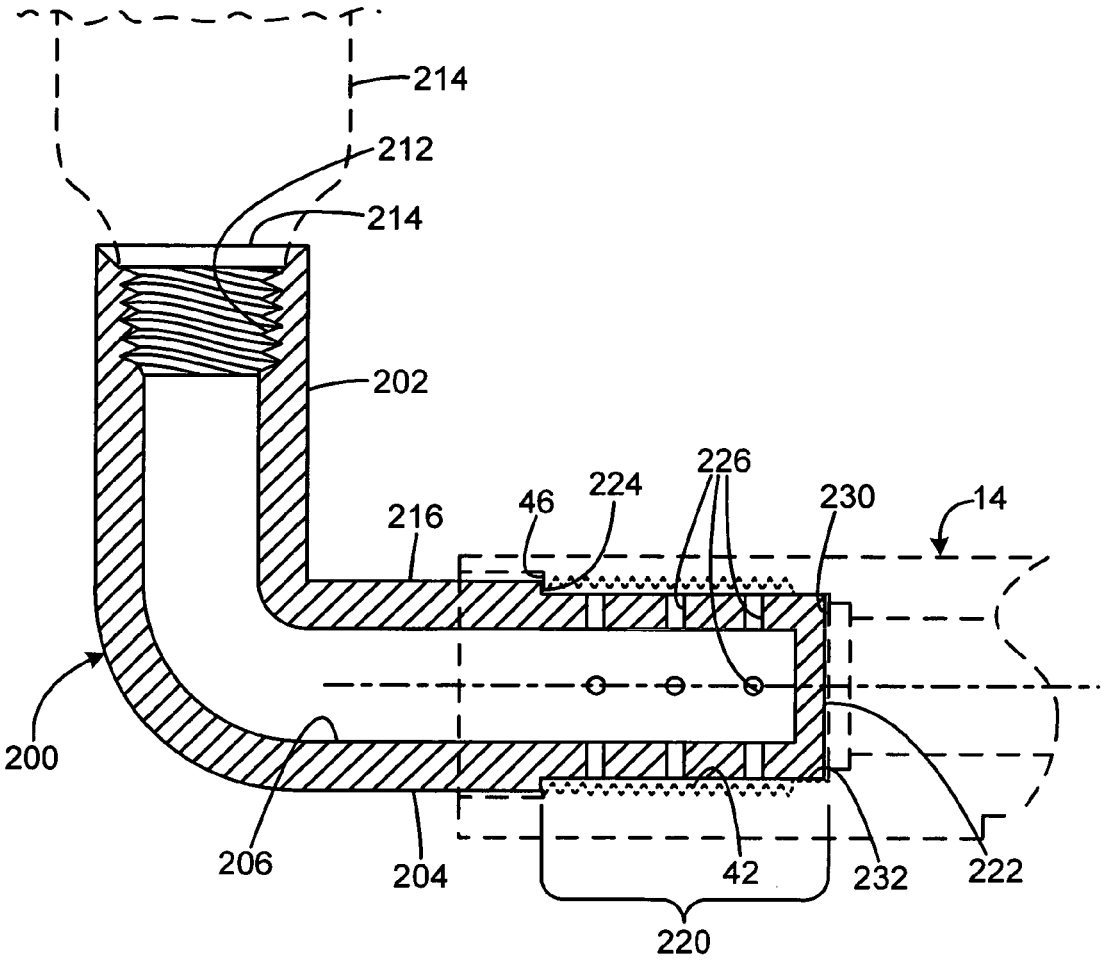
FIG. 4 is a medial sectional side view of lubricant dispensing nozzle according to a preferred embodiment of the invention.

FIG. 4 shows a lubricating nozzle 200 molded of a rigid, solvent resistant plastic such as Acetel, Delrin, etc., in the form of an L-shaped tube or elbow having a straight cylindrical inlet section 202 and a straight cylindrical outlet section 204 joined at a right angle. Each section has a central bore 206. The inlet section has an inlet aperture 210, and the bore near the aperture contains internal or external threads 212 that are configured to meet with the threaded nozzle of a grease container 214, which is filled with an all-purpose grease.

The outlet section 204 has a first portion 216 connected to the inlet portion 202 and having an outside diameter comparable to that of the inlet portion. A cylindrical end portion 220 extends from the first portion 216 to a free end face 222 of the outlet portion, and has a reduced diameter relative to the first portion, such that a shoulder 224 is provided.

The end portion 220 has a number of small lateral apertures 226. In the preferred embodiment a row of apertures is provided on each of a top, a bottom, and opposed side surfaces of the end portion, at 90° intervals about the end portion. Each row includes three apertures each of 0.078 inch diameter, and spaced apart by 0.200 inch. The first aperture is spaced apart from the shoulder 224 by 0.275 inch, and the last aperture is spaced apart from the end face 222 by 0.325 inch.

The end portion 220 has a length of 1.000 inch, which is sized so that the shoulder 224 rests against the shoulder 46 of barrel 14, when the end face 222 rests against a shoulder 230 just forward of the threaded portion 42. The end portion 220 has a diameter of 0.620 inch, which is just slightly smaller than the internal diameter of the unthreaded portion 232 just forward of the threads 42 and adjacent to the shoulder 230. The close slip fit provided between the periphery of the end portion adjacent to the face 222 and the internal diameter 232 provides an adequately narrow gap that prevents significant passage of a thick lubricant such as grease, when the grease is injected through apertures 226 to fill the threads. The shoulder against which the end face 222 rests may also or alternatively provide an effective seal.

A user lubricates the threads 42 of the muzzle loading rifle by screwing a grease container 214 onto the lubricating nozzle 200. The action of the rifle is opened, the extractor is then removed or shifted aside, and the breech plug removed. The end portion 220 of the nozzle is inserted into the bore until the shoulder 224 rests near or against shoulder 46. The grease container 214 is squeezed, which forces the grease through the bore 206, until it entirely fills the nozzle bore. Continued squeezing causes grease to pass through the apertures 226 and begin to fill the gap between the nozzle exterior and the threads. When the threaded areas are filled, grease will begin to visibly ooze at the junction between shoulder 224 and shoulder 46, indicating to the user to stop squeezing.

By spacing apart the apertures 226 from each other within each row, an even distribution of grease is provided. The apertures 226 are spaced farther apart from each other about the circumference than from each other within each row, because the grease flows relatively freely along the length of each thread. By spacing the end apertures well apart from the shoulder 224 and end face 222, the grease tends to fill the threads first, and avoids oozing beyond either end before the threads are filled.

The user then extracts the nozzle from the bore, caps the end portion 220, and reassembles the rifle. The next time an application of grease is needed, the user uncaps the nozzle, and grease will immediately expel from the apertures 226 upon squeezing, as the bore 206 will remain filled with grease after the first use.

Figure 5:
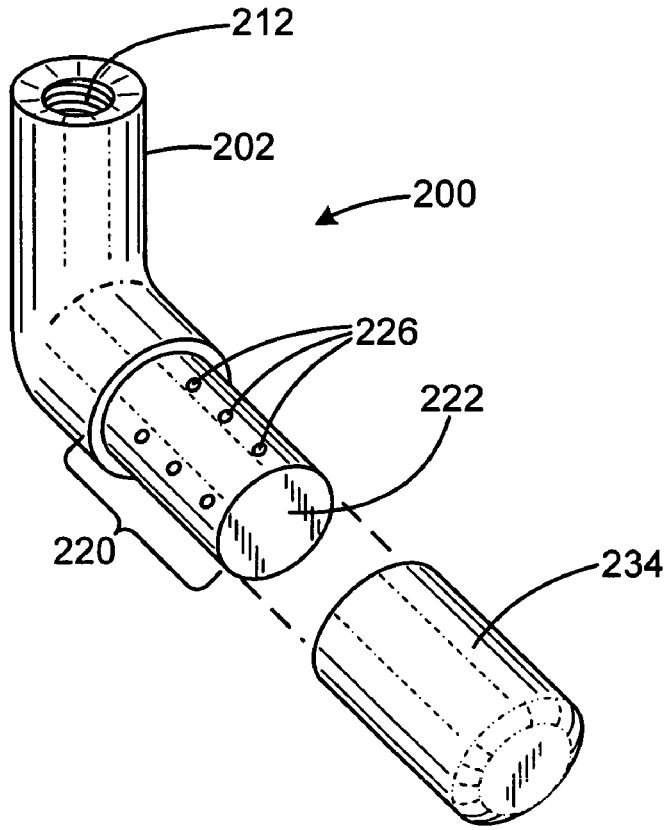
FIG. 5 is a perspective view of a nozzle according to the preferred embodiment of the invention.

FIG. 5 shows how the end portion 220 may be sealed by a cap 234 that closely slides over the end portion.

Figure 6:
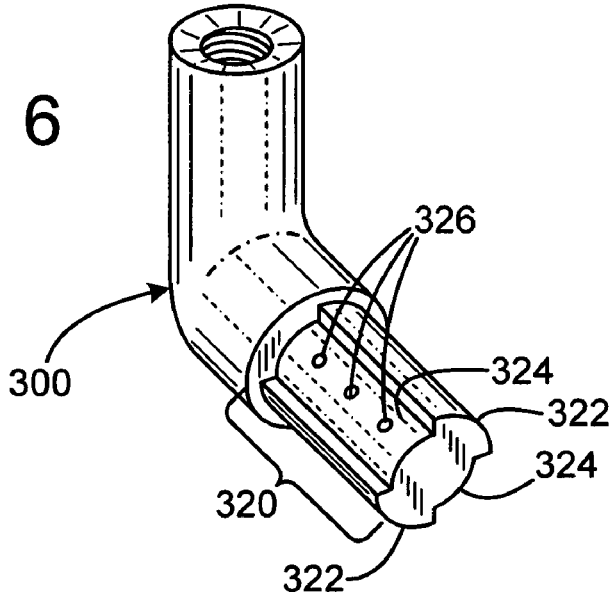
FIG. 6 is a perspective view of a nozzle according to an alternative embodiment of the invention.

FIG. 6 shows an alternative nozzle 300 that is designed for rifles that take breech plugs with interrupted threads, such as shown in FIGS. 3 and 3A. The illustrated nozzle 300 is designed for a rifle breech having a threaded bore with two segments of threads, each covering 90° about the circumference of the bore, and separated from each other by larger unthreaded clearance portions. The clearance portions admit the threaded portions of the breech plug for straight axial insertion, so that the threads of the breech plug may be secured to the threads of the bore with only one quarter turn.

The nozzle 300 has an end portion 320 formed of alternating cylindrical segments having different radii. Each segment covers 90° about the circumference of the end portion 320 (or an appropriate arc angle based on the thread configuration of the rifle.) A pair of large radius portions 322 alternate with a pair of smaller radius portions 324. The large radius portions 322 have a radius designed to provide a tight slip fit within the clearance portions of the bore, so that minimal grease intrudes into this area. The smaller radius portions 324 are designed to closely fit within the threaded portions, similar to the embodiment shown in FIG. 4. The smaller radius portions 324 are provided with small apertures 326, to expel grease into these threaded areas.

While the invention had been described with reference to the preferred embodiment, it will be understood by those skilled in the art that various obvious changes may be made, and equivalents may be substituted for elements thereof, without departing from the essential scope of the present invention. Therefore, it is intended that the invention not be limited to the particular embodiments disclosed, but that the invention includes all embodiments falling within the scope of the appended claims.

The invention claimed is:

1. The combination of:

a rifle barrel extending from a breech end to a muzzle end and having a bore extending from the muzzle end to an inward shoulder proximate the breech end, and an internally threaded breech cavity disposed between the inward shoulder and the breech end, the internal threads having inward peaks defining an inner diameter of the breech cavity greater than the minimum diameter of said rifle barrel; and a nozzle for lubricating only the internally threaded breech cavity of said rifle barrel, said nozzle including an inlet portion with an inlet opening having a surface adapted to receive a fitting of a lubricant container, such that lubricant expelled from said container flows substantially only into the inlet opening, an end portion having an outer cylindrical wall extending from the inlet portion to a closed end and perforated by a plurality of lubricant apertures, and a lubricant passage extending from the inlet opening to the closed end and connecting with each of the lubricant apertures formed through the outer cylindrical wall of the end portion, wherein the lubricant apertures are disposed along the outer cylindrical wall of the end portion such that, when the end portion of said nozzle is inserted into the internally threaded breech cavity of said rifle barrel, the lubricant apertures of said nozzle are registered only with the internal threads of the internally threaded breech cavity of said rifle barrel, the outer cylindrical wall having an outer diameter selected to closely fit within the inner diameter of the internally threaded breech cavity of said rifle barrel and having a length selected such that when the closed end contacts the inward shoulder of said rifle barrel, the lubricant aperture furthest from the closed end of said nozzle is adjacent to the internal threads of said rifle barrel.

2. The combination recited by claim 1, wherein the inlet opening of said nozzle is internally threaded for connection to an outlet nozzle of a lubricant container.

3. The combination recited by claim 1, wherein said nozzle is angled to define an L-shape between the end portion of said nozzle and the inlet opening.

4. The combination recited by claim 1, wherein the outer diameter of the end portion of said nozzle is less than an external diameter of said nozzle adjacent to the end portion, such that a shoulder is formed on the outer surface of said nozzle.

5. The combination recited by claim 1, wherein the lubricant apertures are disposed with respect to the closed end of said nozzle such that the lubricant apertures are disposed substantially in registration with the internal thread grooves of said rifle barrel when the closed end of said nozzle abuts against the inward shoulder formed in said rifle barrel adjacent to the internally threaded breech cavity.

6. The combination recited by claim 5, wherein the breech of said rifle barrel includes a rearward portion disposed between the internally threaded breech cavity and the breech end of said rifle barrel, and the lubricant apertures of said nozzle are disposed with respect to the shoulder of said nozzle such that the lubricant apertures are disposed substantially in registration with the internal thread grooves of said rifle barrel when the shoulder of said nozzle abuts against a radial surface defined between the rearward portion and the internally threaded breech cavity of said rifle barrel.

7. The combination recited by claim 1, wherein the lubricant apertures are evenly distributed about the circumference of the outer cylindrical wall of said nozzle.

8. The combination recited by claim 1, wherein the lubricant apertures are arranged in rows parallel to the lubricant passage.

9. The combination recited by claim 1, further comprising:

a cap defining a cylindrical recess sized to receive the end portion, and to cover all of the lubricant apertures, of said nozzle.

10. The combination recited by claim 1, wherein the outer diameter of said nozzle is determined to provide a close slip fit within the inner diameter of the internally threaded breech cavity of said rifle barrel.

* * * * *